US005269037A

United States Patent [19]

White

[11] Patent Number: 5,269,037

[45] Date of Patent: Dec. 14, 1993

[54] APPLICATOR DEVICE

[76] Inventor: Ronald D. White, P.O. Box 8516, Wrightsville Beach, N.C. 28480

[21] Appl. No.: 980,642

[22] Filed: Nov. 24, 1992

[51] Int. Cl.[5] ..... B05C 21/00; A61H 7/00

[52] U.S. Cl. ..... 15/104.001; 15/188; 128/62 R; 128/67

[58] Field of Search ..... 15/104.001, 110, 188; 128/59, 60, 61, 62 R, 63, 67; 132/320

[56] References Cited

U.S. PATENT DOCUMENTS

| | | | |
|---|---|---|---|
| 827,376 | 7/1906 | Knickerbocker . | |
| 1,007,879 | 11/1911 | Lee . | |
| 1,232,075 | 7/1917 | Oates | 128/62 R |
| 1,554,510 | 9/1925 | Kirby | 15/188 |
| 1,646,324 | 11/1926 | Stewart . | |
| 1,925,019 | 4/1932 | Wilson . | |
| 2,075,413 | 3/1937 | Welker | 15/188 |
| 2,099,030 | 11/1937 | Morrison | 15/104.001 |
| 2,250,878 | 6/1940 | Quaranti . | |
| 2,290,378 | 7/1941 | Motto . | |
| 2,448,846 | 3/1947 | Trochim . | |
| 3,030,967 | 4/1962 | Peyron . | |
| 3,100,483 | 8/1963 | Altmeyer | 128/60 |
| 3,959,841 | 6/1976 | Horne . | |
| 4,249,521 | 2/1981 | Gueret . | |
| 4,463,485 | 8/1984 | Gueret | 128/62 R |
| 4,469,094 | 9/1984 | Kaeser . | |
| 5,131,384 | 7/1992 | Obagi . | |

FOREIGN PATENT DOCUMENTS

| | | | |
|---|---|---|---|
| 3500622 | 7/1986 | Fed. Rep. of Germany | 128/62 R |
| 18840 | of 1912 | United Kingdom | 128/60 |

*Primary Examiner*—Stephen F. Gerrity
*Assistant Examiner*—Randall E. Chin
*Attorney, Agent, or Firm*—Steven J. Hultquist

[57] ABSTRACT

An applicator device comprising a main head having a surface bearing protrusion elements of specified dimensional character. The disclosed device has superior utility for the application to the skin of materials such as skin lotions, tanning oils, salves, massage oils, depilatory creams, shaving creams and gels, personal lubricants, and the like.

17 Claims, 1 Drawing Sheet

APPLICATOR DEVICE

BACKGROUND OF THE INVENTION

1. Field of the Invention

This invention relates to an applicator device of a hand-held character which is usefully employed for the application of lotions, salves, and other flowable substances to the human body.

2. Description of the Related Art

In the application to the human body of various substances such as skin lotions, suntan oils, skin creams, medicaments, and other substances which are applied to the dermal areas of the human body, a wide variety of applicators, dispensers, and administration means have been developed.

A common problem with the application of such flowable materials to the dermal areas is that conventional application means do not adequately take up and retain the flowable material and subsequently at the point of use do not readily release the material to the skin surface. In addition, known applicator means are generally unsuitable for application of materials to hard-to-reach areas of the body (in self-administration of the application material to the user's own body), such as back areas and rear portions of the shoulders and shoulder blades.

Considering specific known applicator means, cloth articles, and cotton balls or swabs are sometimes used in applying substances to skin areas, but these media are very sorbent and take up the flowable material without ready capability of releasing same, except under squeezing or other compression conditions. In contrast, such high pick-up capability, flat-surfaced applicators such as blades, spatulas, and the like do not provide good retention of many flowable or semi-solid materials, since such materials readily drip or slide off the flat application surface.

It would therefore be a significant improvement in the application of flowable, (e.g., high viscosity) liquids or semi-solid materials to dermal areas of the body, to provide a applicator means characterized by superior material pick-up, retention, and release properties.

It therefore is an object of the present invention to provide such an improved applicator device.

It is a further object of the invention to provide an applicator means which is readily adapted to manual self-administration use, to reach normally hard-to-reach areas of the body such as the back and shoulder areas discussed above.

It is a still further object of the invention to provide an applicator device of such type, which is simple and economical in character, and readily fabricated in mass production quantities.

Other objects and advantages will be more fully apparent from the ensuing disclosure and appended claims.

Relative to the applicator device of the present invention, relevant art includes the reference described below.

U.S. Pat. No. 1,007,879 to D. Lee discloses a massage instrument adapted to contain oil or other tissue building medication that may be ejected and applied to the body part to be massaged. The disclosed massage instrument contains a hollow body with continuously circular rows of outwardly projecting perforated cone-shaped nipples on its front face. The device is tapped lightly against the skin in use, to discharge a portion of the oil, which then is messaged into the desired skin area.

U.S. Pat. No. 2,448,846 to M. L. Trochim describes a liquid dispensing device for applying and a massaging on the skin or hair a desired quantity of a liquid such as a lotion or tonic. The applicator comprises a cup-shaped receptacle to hold the liquid and a concave flexible applicator. The applicator is provided with outwardly projecting apertured nipples through which the liquid may be dispensed onto the skin, and a number of rounded projections or knobs to improve the massaging action of the device.

U.S. Pat. No. 1,925,019 to W. Wilson describes a surface treating device incorporating a cup-shaped receiver holding soap lather, massage cream, etc., for application to a particular part of the body through various projections placed on the face of the device.

SUMMARY OF THE INVENTION

The present invention relates to a skin treatment applicator comprising an article including a main head with an array of protrusion surface portions. The main head of the article preferably is joined to a handle member extending proximally of the main head and of a size and shape accommodating manual grippability of the applicator article.

The protrusion surface portions are of a particular size, shape, and surface density for allowing a flowable treatment medium, such as sun lotion, baby oil, or the like, to be maintained on the main head for application to a user's skin.

In a specific embodiment, the applicator is of a specified dimensional character, which is optimally selected to provide ease of use, in take-up, retention, and release of flowable material from the main head, to accommodate use in applying flowable material to normally hard-to-reach areas of a user's body, when the applicator is used for self-administration of a selected material to the user's skin.

In a particular dimensionally specified embodiment, the main head comprises a main applicator surface which preferably is of a planar character (exclusive of the protrusion surface portions thereof) defining a face area (inclusive of the main surface devoid of protrusion surface portions, as well as the protrusion surface portions themselves) which is from about 25 $cm^2$ to about 150 $cm^2$, more preferably from about 40 to about 120 $cm^2$, and most preferably from about 50 to about 100 $cm^2$. For example, the face area may be defined by a generally rectangular applicator surface defining a face of the main head, measuring approximately 11 cm in length and 6 cm in width.

The protrusion surface portions preferably are convex in character, and may be dome-shaped, frustoconical, or hemispheric in character, or may be of any other suitable shape, desirably having a protrusion diameter of from about 0.5 to about 1.5 cm, more preferably from about 0.6 to about 1.2 cm, and most preferably from about 0.7 to about 1.0 cm. Such protrusion surface portions may desirably have a height, measured from the adjacent face surface surrounding the protrusion surface portion to the upper extremity of the protrusion surface portion, which is from about 0.05 cm to about 0.2 cm, more preferably from about 0.05 to about 0.15 cm, and more preferably from about 0.05 to about 0.10 cm.

Protrusion surface portions of the above-described dimensional character, preferably are distributed in a regular array across the face of the main head applicator surface, in such manner as to define a density of protrusion surface portions/cm$^2$ of from about 1 to about 3, preferably from about 1.25 to about 2.5, and more preferably from about 1.5 to about 2.0 protrusion surface portion/cm$^2$.

The applicator of the present invention may simply comprise a main head per se, but desirably includes a proximally extending handle for manual grippability, and consistent with the foregoing dimensional characteristics of the dimensionally specified embodiment of the invention, the handle may have a length of from about 10 to about 40 cm, more preferably from about 15 to about 25 cm, and most preferably from about 20 to about 30 cm.

Preferably the protrusion surface portions are arranged on the face of the main head in a geometrically regular array, such as square array wherein each group of four adjacent protrusion surface portions defines a square pattern with a single protrusion surface portion at each apex of the square, i.e., with the protrusion surface portions in a series of spaced-apart rows of surface protrusion portions, wherein each row defines a line of such protrusion surface portions.

Other features and aspects of the invention will be more fully apparent from the ensuing disclosure and appended claims.

DETAILED DESCRIPTION OF THE INVENTION, AND PREFERRED EMBODIMENTS THEREOF

The present invention is based on the discovery that a highly effective applicator device may be fabricated with very small protrusion surface portions on an applicator face, wherein the protrusion surface portions are of rigorously specified dimensional character.

As used herein, the term "about" in reference to dimensional end-points of a specified dimensional range, e.g., for protrusion surface portion diameter or height parameters, means a variation of $\pm 10\%$.

Figure 1:
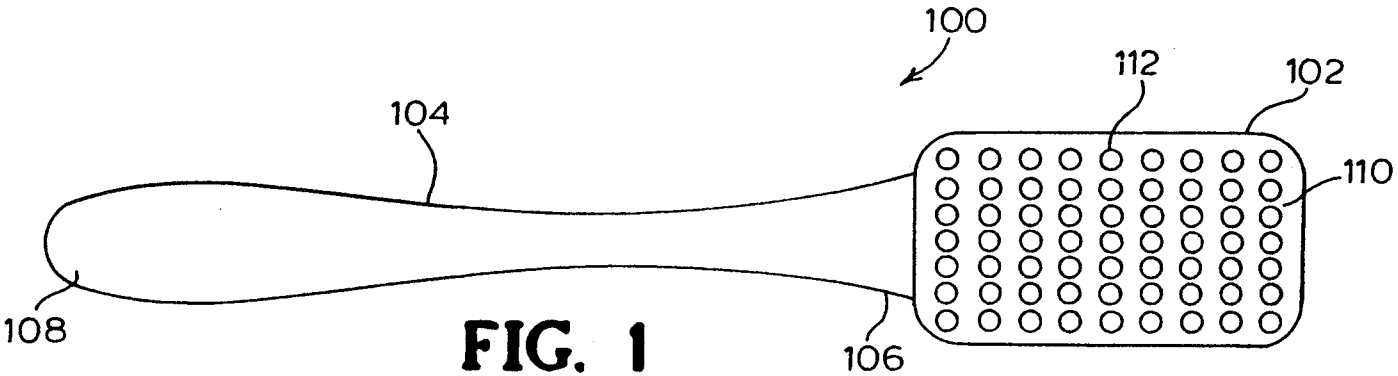
FIG. 1 is a top plan view of an applicator article according to one embodiment of the present invention.

Referring now to the drawings, FIG. 1 shows a top plan view of an applicator article according to one embodiment of the invention.

Figure 2:
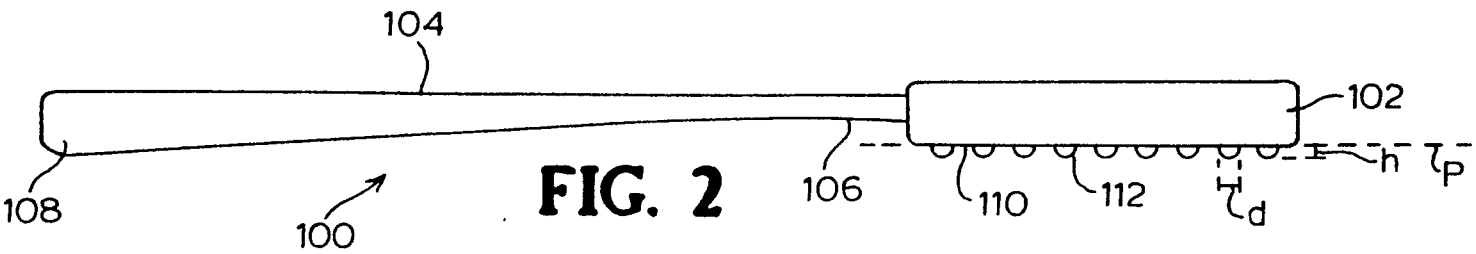
FIG. 2 is a side elevation view of the FIG. 1 applicator article.

As shown in FIG. 1, the applicator 100 comprises a main head portion 102 which is of generally rectangular character, defining an applicator face 110 on the surface of which is provided an array of protrusion surface portions 112 which are uniformly sized and uniformly shaped which as shown in the side elevation view of FIG. 2 are of convex and spherical character (as regards the surface curvature when viewed in side elevation view as in FIG. 2). All article parts and features are numbered correspondingly in FIG. 2, with respect to the same or corresponding elements in FIG. 1.

The main head portion 102 of the applicator article in the embodiment shown features a rearwardly extending handle 104 which is joined to the main head portion 102 at a distal end 106 of the handle. The handle is shaped at its proximal end 108 with an enlarged diameter relative to the intermediate portion of the handle, to facilitate manual gripping of the applicator article in use.

As shown in the side elevation view of FIG. 2, the protrusion surface portions, or protrusion elements, may be of spherical convex shape as shown, having a height h measured from the plane of the face 110 defining the applicator head's base plane, to an outer extremity, and a diameter d of appropriate size.

As mentioned, the protrusion surface portions (protrusion elements) may be of any suitable size, shape, and density (within the dimensional ranges herein specified) on the surface of the main face 110 of the head 102, as appropriate to the specific application.

For general application, accommodating a wide variety of flowable liquid and semi-solid materials, the protrusion elements 112 may have a diameter (d in FIG. 2) which may be from about 0.5 to about 1.5 cm, more preferably from about 0.6 to about 1.2, and most preferably from about 0.7 to about 1.0 cm. The height (h in FIG. 2) may be broadly from about 0.05 to about 0.2 cm, more preferably from about 0.05 to about 0.15 cm, and more preferably from about 0.05 to about 0.10 cm.

The density of the protrusion elements, as appropriate to general purpose application of lotions, oils, salves, and the like, is broadly from about 1 to about 3 protrusions/cm$^2$, more preferably from about 1.25 to about 2.5 protrusion/cm$^2$, and more preferably from about 1.5 to about 2.0 protrusions/cm$^2$.

The face area of the head portion of the applicator, defining the applicator active surface may comprise a surface area of from about 25 to about 150 cm$^2$, more preferably from about 40 to about 100 cm$^2$, and most preferably from about 50 to about 100 cm$^2$.

By way of example, the head 102 of the applicator may be of generally rectangular form as shown, with a length (measured along the longitudinal direction of the head) of about 11 cm, and with a width (measured across the head in a direction transverse to the longitudinal direction), of about 6 cm.

It will be appreciated that the handle of the article shown in FIGS. 1 and 2 is of an optional character, since the applicator may be used as comprising only a main head body having a surface bearing dimples or protrusion elements in accordance with the invention, whereby the applicator may be grasped in the palm of a wearer for use. However, a handle preferably is employed, to extend the reach of the applicator, particularly in uses involving normally hard-to-reach areas of the body, wherein the applicator is used for self-administration of materials such as lotions, oils, salves, and the like.

Accordingly, the handle, when employed, is typically from about 10 to about 40 cm, more preferably from about 15 to about 25 cm, and most preferably from about 20 to about 30 cm.

In an illustrative embodiment, the applicator may be configured as a device of the type shown in FIGS. 1 and 2 hereof, wherein the face 110 of the head 102 bears spherical dimples as protrusion elements, in which the dimples have a diameter of 0.8 cm, a height of 0.08 cm, and are arranged in a rectangular array of the type shown in FIG. 1, with a density of 1.86 dimples/cm$^2$. The face area of the head 102 in such illustrative embodiment is 60 cm$^2$, and the handle has a length of 24 cm.

It will be recognized that the specific height, diameter, shape, and density of the protrusion elements in the broad practice of the present invention may be varied within the foregoing narrow ranges to optimal benefit, depending on the viscosity and drip (sag) characteristics of the material to be applied with the applicator. The foregoing narrow ranges of dimensional characteristics for protrusion, diameter, height, and density accommodate particularly well the pick-up, retention, and release of hand and body lotions of conventional commercial type, as well as sunscreen materials, tanning oils, massage oils, depilatory creams, shaving creams and gels, personal lubricants, and the like.

The applicator device of the present invention may be formed of any suitable material of construction, such as plastic or polymeric materials, wood, metal, ceramic, composite materials, rubber or elastomeric materials of suitable hardness, etc. Preferably, the applicator device is formed of an injection moldable plastic material such as polyvinylchloride, polyethylene, polycarbonate, polysulfone, etc., or other suitable materialof a thermoplastic or thermosetting character, as necessary or desired in a specific application.

In the preferred injection molding method of manufacturing, the applicator article is integrally formed as a single piece device. Alternatively, it may be desirable in some applications to separately form or provide the protrusion elements, which then subsequently are affixed or secured to the main head portion of the applicator.

As an example of the latter approach, a head and handle having a flat applicator face may be initially formed or provided, into the head portion of which a series of holes are drilled in an array corresponding to the desired protrusion surface portions of the final applicator device. Such drilled holes may be filled with a material which swells slightly upon curing. The curable material may be applied to the face of the head with a trowel or other applicator device which produces filling of the holes, without any accumulation of extraneous material on the applicator face of the main head (on the flat surfaces surrounding the drilled holes). The holes filled with the curable material then contain the material, during its curing and subsequent slight swelling, to produce short "bumps" or dimples on the applicator face, producing a protrusion array similar to that shown in FIGS. 1 and 2. An example of such curable, swellable material is the marine filler material commercially available under the trademark Marine-Tex®.

Concerning the reasons for the endpoint values in the various ranges described for the protrusion element diameter, height, and density, such ranges have been determined to be optimally suited for the application of commonly employed materials administered to the skin, such as those illustratively mentioned above.

Concerning specific parametric values, if the diameter of the protrusion elements is less than about 0.5 cm, the protrusion elements become unsuitably small to retain the material to be applied, and the resulting applicator face exhibits poor pick-up and release quality, in respect of the material to be applied to the skin. Conversely, if the protrusion element diameter exceeds about 1.5 cm, the "interstitial" spaces between adjacent protrusion elements becomes an unsuitably small portion of the applicator face, unable to accommodate sufficient quantity of material to be applied to the skin. The more preferred and most preferred diameter ranges represent a further optimized balance of such competing considerations dictating the endpoints of the broad diameter range.

Concerning height of the protrusion elements, if the height is less than about 0.05 cm, the face of the main head becomes unduly planar, with result that the pick-up and retention characteristics of the protrusion element-bearing face is unsuitably low. If, on the other hand, the height of the protrusion elements exceeds about 0.2 cm, the pick-up and release efficiency of the applicator becomes disproportionately reduced, with the interior interstitial space between adjacent protrusion elements becoming deeper and less accessible to the material to be "loaded" on the applicator face and then released onto the skin surface. The end-points of the more preferred and most preferred height subranges represent further optimized balances of the competing considerations dictating the respective end points of the broad height range.

The density range of from about 1 to about 3 protrusion elements/$cm^2$ are correlative to the appertaining broad ranges for the diameter and height values. If the protrusion element density on the face of the main head becomes less than about 1 protrusion element/$cm^2$, there is an insufficient concentration of surface convolutions to assure good pick-up and retention characteristics for the applicator face. If the density of protrusion elements is greater than about 3 protrusion elements/$cm^2$, the number of protrusion elements becomes sufficiently high that insufficient interstitial space between adjacent protrusion elements is provided (for good-capacity loading of the substance to be applied to the skin). The more preferred and most preferred protrusion density ranges represent further optimized balances of the considerations dictating the endpoints of the broad range of protrusion element density.

Corresponding considerations apply to the area range characterizing the face area of the main head, and the handle length applicable to a handle, when a handle is employed with the main head of the device. The face area must be sufficiently large to give good loading of material to be applied to the skin, and not so excessively large that surplus material is provided, with the result that the surplus material drips or slides off of the applicator face before it can be translated to the skin. The handle length is sized so as to be at least of a dimension accommodating reaching of the aforementioned normally hard-to-reach areas of the body, and the handle must not be excessively long, such that it becomes unwieldy and clumsy to use.

In use, I have found the applicator device of the present invention to be far superior to any commercially available applicators for administering of skin lotion and suntan oils to the skin.

While the invention is of a generally simple appearance, such visual simplicity belies the fact that the optimized dimensional character of the device of my invention provides a highly superior applicator article, much superior to articles of the prior art.

Further, the invention has been shown and described with respect to specific embodiments, features, and aspects, it will be appreciated that numerous modifications, variations, and other embodiments are feasible within the broad scope of the present invention, and such modifications, variations, and embodiments are therefore to be regarded as being within the spirit and scope of the invention.

What is claimed is:

1. An applicator device comprising a main head defining a planar applicator face comprising an array of uniformly sized and uniformly shaped protrusion surface portions thereon, wherein the protrusion surface portions are surrounded by planar surface portions of the applicator face, wherein the protrusion surface portions are of convex character protruding upwardly from the applicator face and have a diameter of from about 0.5 to about 1.5 cm, a height measured from the planar face of from about 0.05 to about 0.2 cm, a height-to-diameter ratio of from about 0.03 to about 0.40, and a protrusion surface portion density of from about 1 to about 3 surface protrusion portions/$cm^2$.

2. An applicator device according to claim 1, wherein the protrusion surface portions are of partial spherical shape.

3. An applicator device according to claim 1, wherein the protrusion surface portions are positioned in holes formed in the main head applicator face and are formed of cured swelled material defining bumps as the protrusion surface portions.

4. An applicator device according to claim 1, wherein the protrusion surface portions have a diameter of from about 0.6 to about 1.2 cm, a height of from about 0.05 to about 0.15 cm, and a density of from about 1.25 to about 2.5 protrusion surface portions/$cm^2$.

5. An applicator device according to claim 1, wherein the protrusion surface portions have a diameter of from about 0.7 to about 1.0 cm, a height of from about 0.05 to about 0.10 cm, and a density of from about 1.5 to about 2.0 protrusion surface portions/$cm^2$.

6. An applicator device according to claim 1, wherein the applicator face has a surface area of from about 25 to about 150 $cm^2$.

7. An applicator device according to claim 1, wherein the applicator face has a surface area of from about 40 to about 120 $cm^2$.

8. An applicator device according to claim 1, wherein the applicator face has a surface area of from about 50 to about 100 $cm^2$.

9. An applicator device according to claim 1, further comprising a handle secured to the main head.

10. An applicator device according to claim 9, wherein the handle has length of from about 10 to about 40 cm.

11. An applicator device according to claim 9, wherein the handle has length of from about 15 to about 25 cm.

12. An applicator device according to claim 9, wherein the handle has length of from about 20 to about 30 cm.

13. An applicator device according to claim 1, formed of a material of construction selected from those of the group consisting of: plastics; polymeric materials; metals; ceramics; wood; composite materials; and combinations thereof.

14. An applicator device according to claim 1, wherein the main head is integrally secured to a handle member of manually graspable size and shape, and the handle and main head are integrally formed as a single-piece article.

15. An applicator device according to claim 14, wherein the device has been formed by injection molding.

16. An applicator device comprising a main head defining a planar applicator face comprising an array of uniformly sized and uniformly shaped protrusion surface portions thereon, wherein the protrusion surface portions are surrounded by planar surface portions of the applicator face, wherein the protrusion surface portions are of convex character protruding upwardly from the applicator face and have a diameter of from about 0.6 to about 1.2 cm, a height measured from the planar face of from about 0.05 to about 0.20 cm, a height-to-diameter ratio of from about 0.04 to about 0.33, and a protrusion surface portion density of from about 1.25 to about 2.5 surface protrusion portions/$cm^2$.

17. An applicator device comprising a main head defining a planar applicator face comprising an array of uniformly sized and uniformly shaped protrusion surface portions thereon, wherein the protrusion surface portions are surrounded by planar surface portions of the applicator face, wherein the protrusion surface portions are of convex character protruding upwardly from the applicator face and have a diameter of from about 0.7 to about 1.0 cm, a height measured from the planar face of from about 0.05 to about 0.15 cm, a height-to-diameter ratio of from about 0.05 to about 0.21 and a protrusion surface portion density of from about 1.5 to about 2.0 surface protrusion portion/$cm^2$.

* * * * *

UNITED STATES PATENT AND TRADEMARK OFFICE

CERTIFICATE OF CORRECTION

PATENT NO. : 5,269,037

DATED : December 14, 1993

INVENTOR(S) : Ronald D. White

It is certified that error appears in the above-indentified patent and that said Letters Patent is hereby corrected as shown below:

On the title page, item [76], delete "P.O. Box 8516", and insert -- 7-A Meier Street--.

Signed and Sealed this

Sixteenth Day of January, 1996

Bruce Lehman

*Attest:*

BRUCE LEHMAN

*Attesting Officer*

*Commissioner of Patents and Trademarks*